US007962979B1

(12) United States Patent
Hime

(10) Patent No.: US 7,962,979 B1
(45) Date of Patent: Jun. 21, 2011

(54) HOSPITAL BED ASSEMBLY

(76) Inventor: Jill N. Hime, Ypsilanti, MI (US)

( * ) Notice: Subject to any disclaimer, the term of this patent is extended or adjusted under 35 U.S.C. 154(b) by 112 days.

(21) Appl. No.: 12/437,378

(22) Filed: May 7, 2009

(51) Int. Cl.
*A47B 71/00* (2006.01)

(52) U.S. Cl. ..... 5/600; 5/613; 5/658; 5/424

(58) Field of Classification Search ..... 5/600, 613, 5/424, 658, 425, 428, 430, 631
See application file for complete search history.

(56) References Cited

U.S. PATENT DOCUMENTS

| | | | | |
|---|---|---|---|---|
| 3,835,486 | A * | 9/1974 | Benoit et al. | 5/503.1 |
| 4,183,015 | A * | 1/1980 | Drew et al. | 5/658 |
| D272,395 | S | 1/1984 | Sonder et al. | |
| 4,612,679 | A | 9/1986 | Mitchell | |
| 4,947,298 | A * | 8/1990 | Stephen | 362/130 |
| 4,998,939 | A * | 3/1991 | Potthast et al. | 5/424 |
| 5,969,488 | A * | 10/1999 | Fromson | 5/618 |
| 6,240,581 | B1 * | 6/2001 | Pender | 5/505.1 |
| 6,817,363 | B2 * | 11/2004 | Biondo et al. | 128/845 |
| 6,901,616 | B1 * | 6/2005 | Warrington et al. | 5/505.1 |
| 7,017,208 | B2 | 3/2006 | Weismiller et al. | |
| 7,213,279 | B2 | 5/2007 | Weismiller et al. | |
| 7,237,287 | B2 | 7/2007 | Weismiller et al. | |
| 7,281,282 | B2 * | 10/2007 | Huber | 5/505.1 |
| 2001/0029628 | A1 | 10/2001 | Ferrand et al. | |
| 2004/0074008 | A1 | 4/2004 | Martens et al. | |
| 2009/0151073 | A1 * | 6/2009 | Kramer | 5/610 |
| 2010/0125950 | A1 * | 5/2010 | Powell et al. | 5/503.1 |

* cited by examiner

*Primary Examiner* — Robert G Santos
*Assistant Examiner* — Brittany M Wilson

(57) ABSTRACT

A hospital bed assembly includes a platform that has a top side, a bottom side, a pair of lateral edges, a back edge, and a front edge. The platform includes a first section including the front edge and a second section including the back edge. A plurality of supports is attached to and extends downwardly from the platform. A headboard is attached to the back edge and a footboard is attached to the front edge. A mattress is positioned on the top side of the platform. A plurality of sleeves is provided. Each of the headboard and the footboard has at least one of the sleeves mounted thereto and the sleeves each have an upper end is open. Each of a plurality of support posts is removably extendable into one of the sleeves.

12 Claims, 6 Drawing Sheets

HOSPITAL BED ASSEMBLY

BACKGROUND OF THE DISCLOSURE

1. Field of the Disclosure

The disclosure relates to bed devices and more particularly pertains to a new bed device for a hospital patient.

2. Summary of the Disclosure

An embodiment of the disclosure meets the needs presented above by generally comprising a platform that has a top side, a bottom side, a pair of lateral edges, a back edge, and a front edge. The platform includes a first section including the front edge and a second section including the back edge. A plurality of supports is attached to and extends downwardly from the platform. A headboard is attached to the back edge and a footboard is attached to the front edge. A mattress is positioned on the top side of the platform. A plurality of sleeves is provided. Each of the headboard and the footboard has at least one of the sleeves mounted thereto and the sleeves each have an upper end is open. Each of a plurality of support posts is removably extendable into one of the sleeves.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
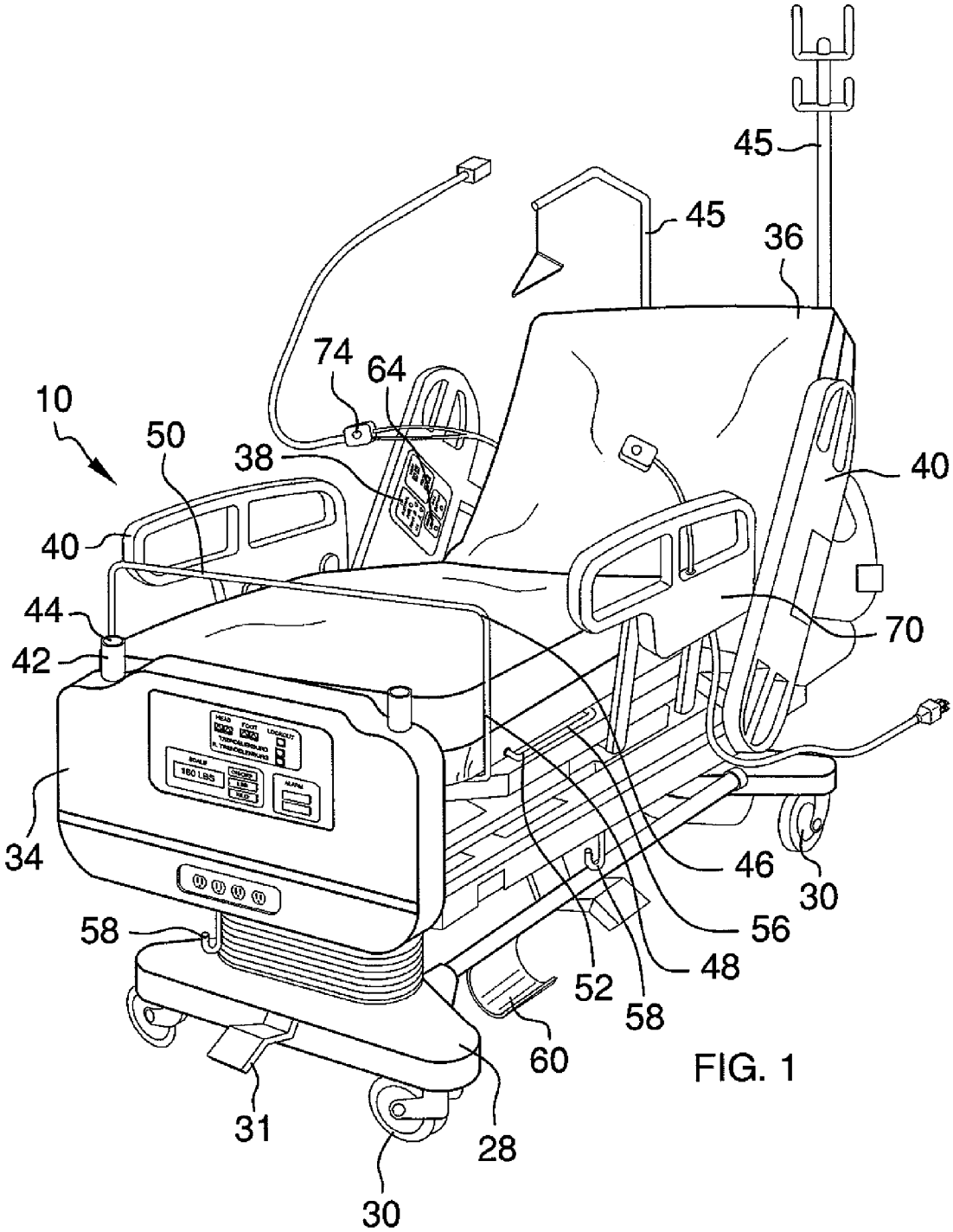
FIG. 1 is a front perspective view of a hospital bed assembly according to an embodiment of the disclosure.
Figure 2:
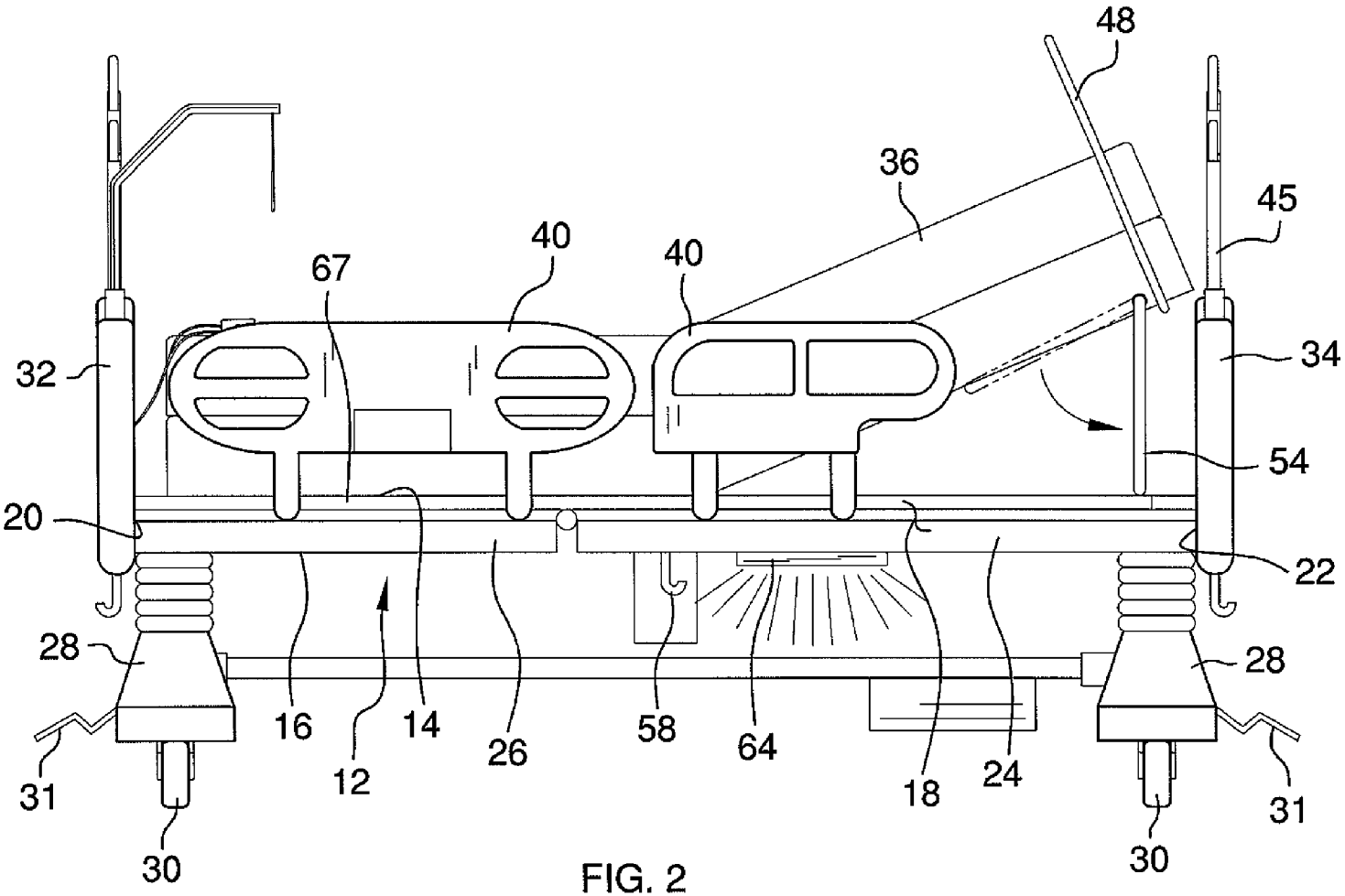
FIG. 2 is a side view of an embodiment of the disclosure.
Figure 3:
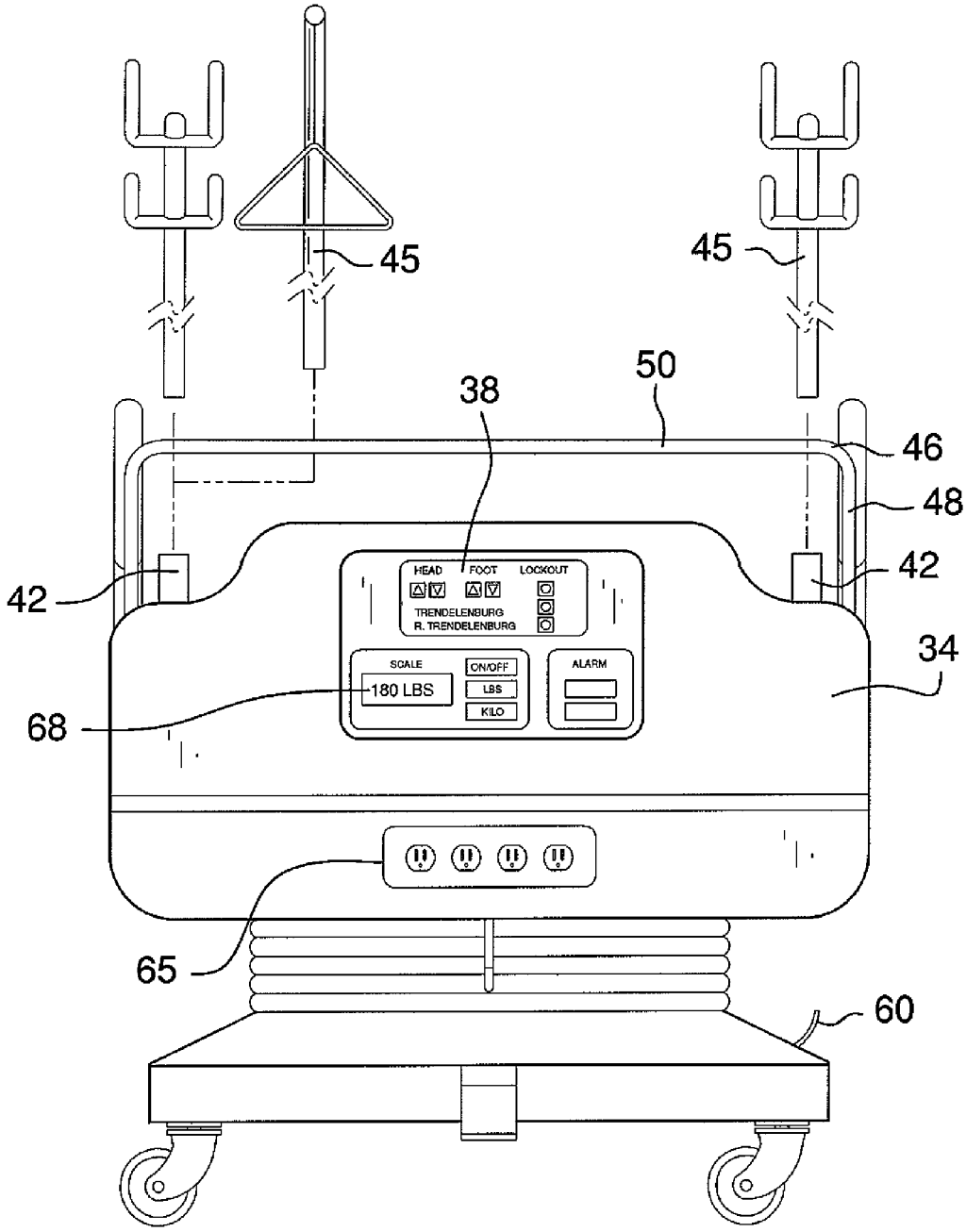
FIG. 3 is a front view of an embodiment of the disclosure.
Figure 4:
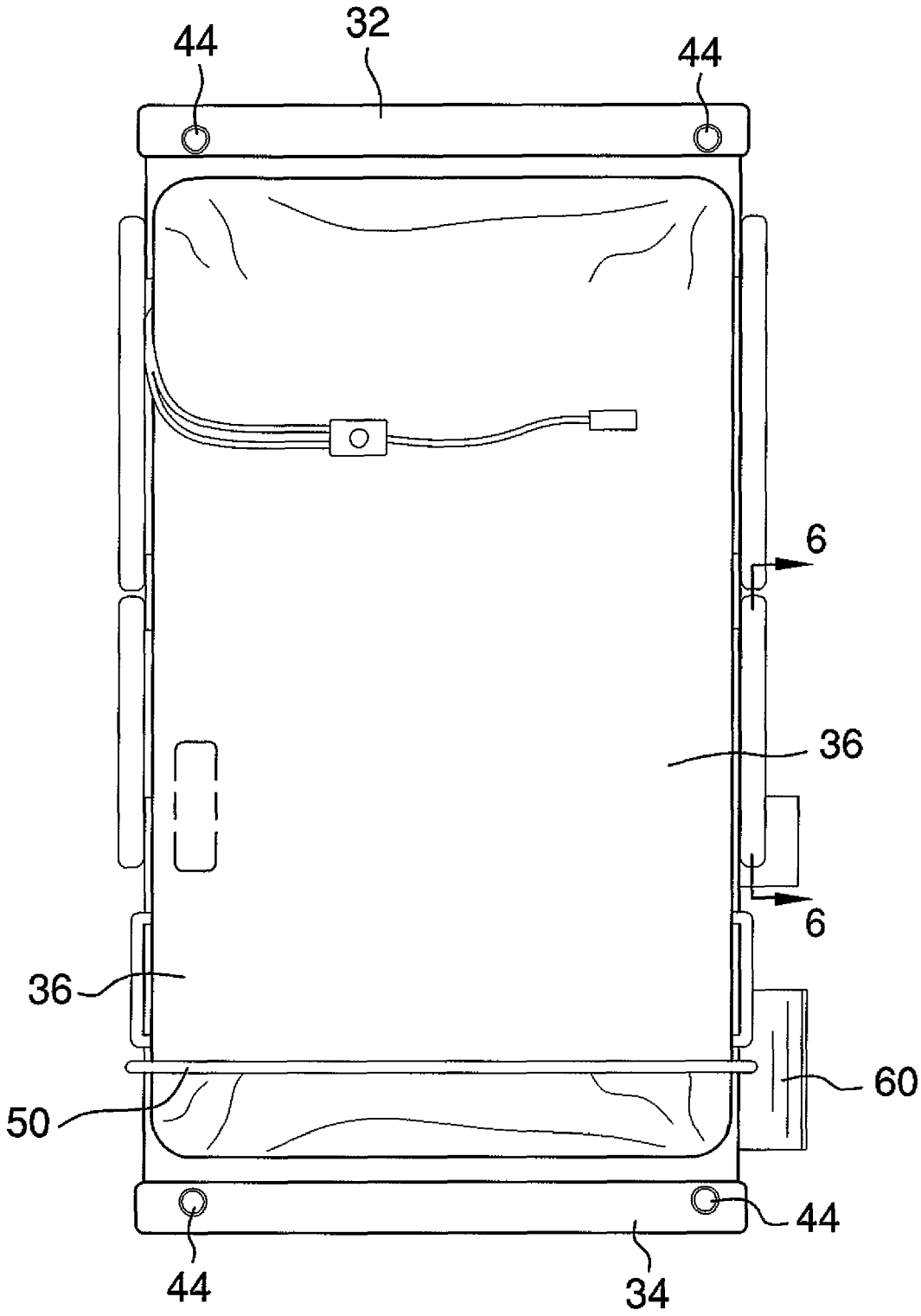
FIG. 4 is a top view of an embodiment of the disclosure.
Figure 5:
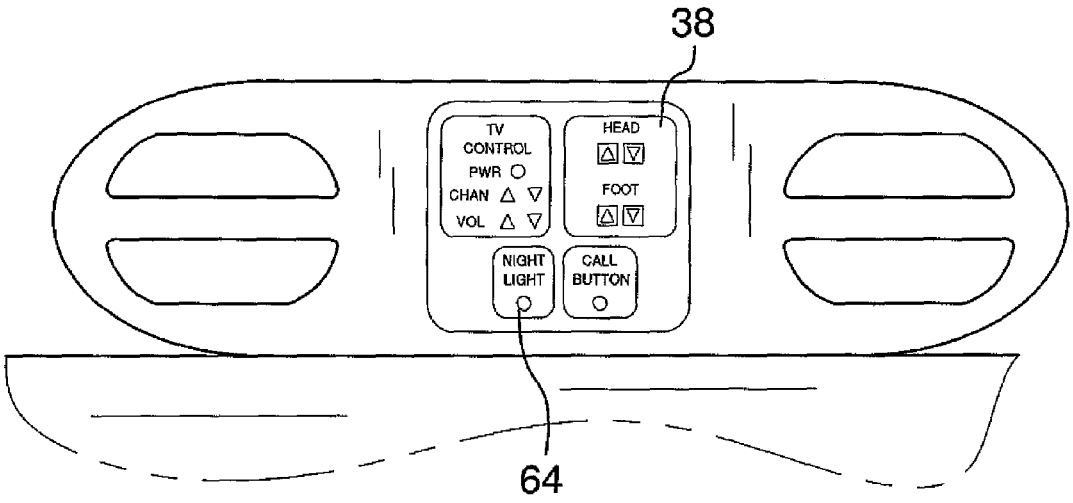
FIG. 5 is a front view of controls of an embodiment of the disclosure.
Figure 6:
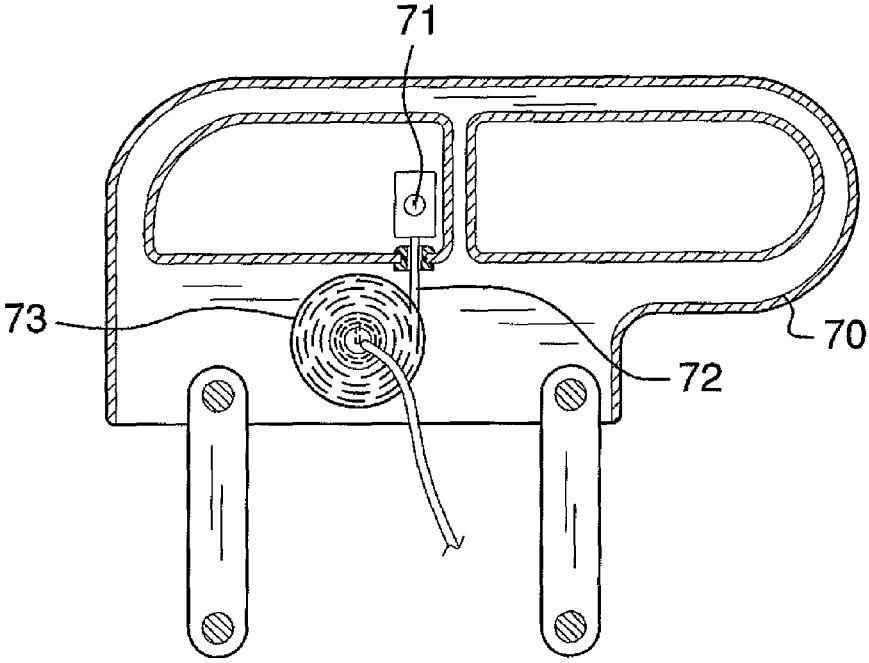
FIG. 6 is a cross-sectional view of a housing of an embodiment of the disclosure.
Figure 7:
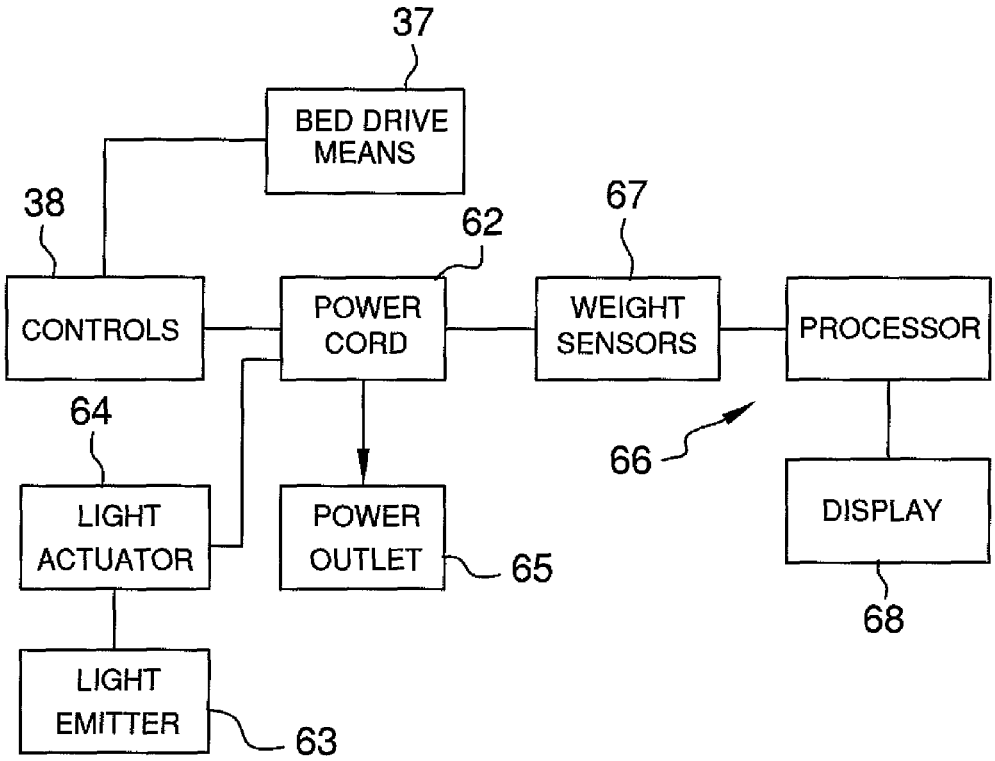
FIG. 7 is a schematic view of an embodiment of the disclosure.

With reference now to the drawings, and in particular to FIGS. 1 through 7 thereof, a new bed device embodying the principles and concepts of an embodiment of the disclosure and generally designated by the reference numeral 10 will be described.

As best illustrated in FIGS. 1 through 7, the hospital bed assembly 10 generally comprises a platform 12 that has a top side 14, a bottom side 16, a pair of lateral edges 18, a back edge 20, and a front edge 22. The platform 12 includes a first section 24 including the front edge 22 and a second section 26 including the back edge 20. The first 24 and second 26 sections are pivotal with respect to each other. A plurality of supports 28 is attached to and extends downwardly from the platform 12. A plurality of wheels 30 is attached to the supports 28 to facilitate movement of the platform 12. A conventional brake may be used to lock the wheels 30. A headboard 32 is attached to the back edge 20 and a footboard 34 is attached to the front edge 22. A mattress 36 is positioned on the top side 14 of the platform 12. The platform 12, supports 28, headboard 32, footboard 34 and mattress 36 are generally conventional to hospital beds and would include conventional gear and motor means 37 for lifting the first 24 and second 26 sections with respect to each other and would include controls 38 for such. The controls 38 may be mounted on the footboard 34 and on guardrails 40 attached to the platform 12. The guardrails are selectively adjustable vertically with respect to the platform 12.

A plurality of sleeves 42 is provided. Each of the headboard 32 and the footboard 34 has at least one of the sleeves 42 mounted thereto. Each of the sleeves 42 has an open upper end 44. Each of a plurality of support posts 45 is removably extendable into one of the sleeves 42. The support posts 45 may include posts for traction devices, lifting grips as well as supports for fluid containing bags for intravenous drips.

A blanket support 46 is attached to the mattress 36 and extends over an upper surface of the mattress 36 adjacent to the front edge 22 to support blankets off of the mattress 36. The blanket support 46 includes a pair of arms 48 and a central member 50 extending between the arms 48. Each of the arms 48 is positioned adjacent to one of a pair of lateral sides of the mattress 36 and the central member 50 extends over the upper surface of the mattress. The central member 50 is spaced from the mattress a distance of between 5 inches and 16 inches. The blanket support 46 spaces a blanket, positioned over the blanket support 46, from a person's feet to allow for easier movement of the person's feet.

A mattress support 52 is attached to the mattress and extends under a lower surface of the mattress 36 adjacent to the front edge 22. The mattress support 52 includes a pair of legs 54 and an elongated member 56 extending between the legs 54. Each of the legs 54 is positioned adjacent to one of the lateral sides 18. Each of the legs 54 is pivotally coupled to the mattress 36 to allow the legs 54 to be positioned in a stored position having the elongated member 56 abutting the lower surface of the mattress 46 or in a deployed position spacing the elongated member 56 from the lower surface of the mattress and lifting a portion of the mattress 36 adjacent to the front edge 22 upwardly from the platform 12. The mattress support 52 may be mechanically coupled to a drive mechanism which lifts and lowers the mattress 36 or the first section 24 of the platform 12 may include a drive mechanism. Alternatively, the mattress 36 may be lifted or lowered manually by moving the elongated member 56 as described above.

A plurality of hook members 58 is attached to and extends downwardly from the platform 12. One or more intravenous lines are positionable on the hooks 58 to control movement of the intravenous lines. The hooks 58 prevent the intravenous lines from being entangled and accidentally being pulled from a person's body. A saddle 60 is attached to the platform 12. An oxygen tank is positionable in the saddle. This provides for easy transportation of the platform 12 and mattress along with an oxygen tank. The hooks 58 may be used for holding air lines from the oxygen tank to the person.

A power cord 62 is pluggable into an electrical power source. The power cord 62 may be the power cord used for a conventional motorized bed as would typically be found in a hospital setting. A light emitter 63 is attached to the bottom side 16 of the platform 12 and is electrically coupled to the power cord 62. A light actuator 64 is in electrical communication with the light emitter 63 to selectively turn the light emitter 63 on or off. The light actuator 64 is mounted on a guard rail 40 mounted to the platform. The light emitter 63 may be used as a low level light to provide visual indication of a floor surface without having to turn on overhead lights. A plurality of female power outlets 65 is mounted to the footboard and is electrically coupled to the power cord.

A weight measuring system 66 is electrically coupled to the power cord 62 and includes a weight sensor 67 mounted in or on the platform 12 to detect and measure weight positioned on the platform. The weight measuring system further includes a display 68 electrically coupled to the weight sensor 67 to electronically display a weight being measured by the weight sensor 67. The display 68 is mounted on the footboard.

A housing 70, which may also function as a guardrail, is attached to one of the lateral edges 18 of the platform 12. A nurse call actuator 71 extends outwardly of the housing 70 and is electrically couplable to a paging system. The nurse call actuator 71 includes an extension cord 72 extending into the housing 70 and is wound on a rotatable spool 73. A rotation of the spool 73 is biased in one direction to pull the extension cord 72 into the housing 70. The nurse call actuator 71 may be used in conjunction with a conventional nurse call button 74 but ensures that a patient will have a call actuator adjacent to them at all times.

In use, the assembly 10 is used in a conventional manner as a hospital bed but which includes conveniences such the light emitter 64, power outlets 65 and weight measuring system 66 which makes the bed more user friendly for a patient.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A hospital bed apparatus comprising:

a platform having a top side, a bottom side, a pair of lateral edges, a back edge, and a front edge, said platform including a first section including said front edge and a second section including said back edge;

a plurality of supports being attached to and extending downwardly from said platform;

a headboard being attached to said back edge and a footboard being attached to said front edge;

a mattress being positioned on said top side of said platform; and a plurality of sleeves, each of said headboard and said footboard having at least one of said sleeves mounted thereto, each of said sleeves having an upper end being open, each of a plurality of support posts being removably extendable into one of said sleeves; and a housing being attached to one of said lateral edges of said platform, a nurse call actuator extending outwardly of said housing and being electrically couplable to a paging system, said nurse call actuator including an extension cord extending into said housing and being wound on a rotatable spool, a rotation of said spool being biased in one direction to pull said extension cord into said housing.

2. The apparatus according to claim 1, further including a blanket support being attached to said mattress and extending over an upper surface of said mattress adjacent to said front edge to support blankets off of said mattress.

3. The apparatus according to claim 2, wherein said blanket support includes a pair of arms and a central member extending between said arms, each of said arms being positioned adjacent to one of a pair of lateral sides of said mattress and said central member extending over said upper surface, said central member being spaced from said upper surface a distance of between 5 inches and 16 inches.

4. The apparatus according to claim 1, further including a mattress support being attached to said mattress and extending under a lower surface of said mattress adjacent to said front edge, said mattress support including a pair of legs and an elongated member extending between said legs, each of said legs being positioned adjacent to one of said lateral sides, each of said legs being pivotally coupled to said mattress to allow said legs to be positioned in a stored position having said elongated member abutting said lower surface or in a deployed position spacing said elongated member from said lower surface and lifting a portion of said mattress adjacent to said front edge upwardly from said platform.

5. The apparatus according to claim 1, further including a plurality of hook members being attached to and extending downwardly from said platform, wherein one or more intravenous lines are positionable on said hooks to control movement of the intravenous lines.

6. The apparatus according to claim 5, further including a saddle being attached to said platform, wherein an oxygen tank is positionable in said saddle.

7. The apparatus according to claim 1, further including:

a power cord being pluggable into an electrical power source; and a light emitter being attached to said bottom side of said platform and being electrically coupled to said power cord.

8. The apparatus according to claim 7, further including a light actuator being in electrical communication with said light emitter to selectively turn said light emitter on or off, said light actuator being mounted on a guard rail mounted to said platform.

9. The apparatus according to claim 1, further including:

a power cord being pluggable into an electrical power source; and a plurality of female power outlets being mounted to said footboard and being electrically coupled to said power cord.

10. The apparatus according to claim 1, further including:

a power cord being pluggable into an electrical power source;

a weight measuring system being electrically coupled to said power cord and including a weight sensor being mounted in said platform to detect and measure weight positioned on said platform, said weight measuring system further including a display electrically coupled to said weight sensor to electronically display a weight being measured by said weight sensor, said display being mounted on said footboard.

11. The apparatus according to claim 1, further including a saddle being attached to said platform, wherein an oxygen tank is positionable in said saddle.

12. A hospital bed apparatus comprising:

a platform having a top side, a bottom side, a pair of lateral edges, a back edge, and a front edge, said platform including a first section including said front edge and a second section including said back edge, said first and second sections being pivotal with respect to each other;

a plurality of supports being attached to and extending downwardly from said platform, a plurality of wheels being attached to said supports to facilitate movement of said platform;

a headboard being attached to said back edge and a footboard being attached to said front edge;

a mattress being positioned on said top side of said platform;

a plurality of sleeves, each of said headboard and said footboard having at least one of said sleeves mounted thereto, each of said sleeves having an upper end being open, each of a plurality of support posts being removably extendable into one of said sleeves;

a blanket support being attached to said mattress and extending over an upper surface of said mattress adjacent to said front edge to support blankets off of said mattress, said blanket support including a pair of arms and a central member extending between said arms, each of said arms being positioned adjacent to one of a pair of lateral sides of said mattress and said central member extending over said upper surface, said central member being spaced from said upper surface a distance of between 5 inches and 16 inches;

a mattress support being attached to said mattress and extending under a lower surface of said mattress adjacent to said front edge, said mattress support including a pair of legs and an elongated member extending between said legs, each of said legs being positioned adjacent to one of said lateral sides, each of said legs being pivotally coupled to said mattress to allow said legs to be positioned in a stored position having said elongated member abutting said lower surface or in a deployed position spacing said elongated member from said lower surface and lifting a portion of said mattress adjacent to said front edge upwardly from said platform;

a plurality of hook members being attached to and extending downwardly from said platform, wherein one or more intravenous lines are positionable on said hooks to control movement of the intravenous lines;

a power cord being pluggable into an electrical power source;

a light emitter being attached to said bottom side of said platform and being electrically coupled to said power cord;

a light actuator being in electrical communication with said light emitter to selectively turn said light emitter on or off, said light actuator being mounted on a guard rail mounted to said platform;

a plurality of female power outlets being mounted to said footboard and being electrically coupled to said power cord;

a weight measuring system being electrically coupled to said power cord and including a weight sensor being mounted in said platform to detect and measure weight positioned on said platform, said weight measuring system further including a display electrically coupled to said weight sensor to electronically display a weight being measured by said weight sensor, said display being mounted on said footboard;

a housing being attached to one of said lateral edges of said platform, a nurse call actuator extending outwardly of said housing and being electrically couplable to a paging system, said nurse call actuator including an extension cord extending into said housing and being wound on a rotatable spool, a rotation of said spool being biased in one direction to pull said extension cord into said housing; and a saddle being attached to said platform, wherein an oxygen tank is positionable in said saddle.

* * * * *